US009605372B2

(12) United States Patent
Kim et al.

(10) Patent No.: US 9,605,372 B2
(45) Date of Patent: Mar. 28, 2017

(54) LAUNDRY TREATMENT APPARATUS

(71) Applicant: LG ELECTRONICS INC., Seoul (KR)

(72) Inventors: Kihyuk Kim, Changwon-si (KR); Eunyoung Chee, Changwon-si (KR); Youjin Chung, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/488,640

(22) Filed: Sep. 17, 2014

(65) Prior Publication Data

US 2015/0076977 A1 Mar. 19, 2015

(30) Foreign Application Priority Data

Sep. 17, 2013 (KR) ..... 10-2013-0112152

(51) Int. Cl.

| | |
|---|---|
| ***A47B 77/06*** | (2006.01) |
| ***A47K 1/04*** | (2006.01) |
| ***A47L 19/02*** | (2006.01) |
| ***E03C 1/18*** | (2006.01) |
| ***D06F 39/00*** | (2006.01) |
| ***D06F 39/14*** | (2006.01) |
| ***D06F 37/12*** | (2006.01) |
| ***D06F 37/28*** | (2006.01) |

(52) U.S. Cl.

CPC ..... *D06F 39/005* (2013.01); *D06F 37/12* (2013.01); *D06F 37/28* (2013.01); *D06F 39/14* (2013.01)

(58) Field of Classification Search

CPC ..... D06F 39/14; D06F 37/10; D06F 37/12; D06F 37/18; D06F 37/28; D06F 39/005

USPC ..... 68/196, 24, 12.26

See application file for complete search history.

(56) References Cited

U.S. PATENT DOCUMENTS 2,831,219 A * 4/1958 Nelson ..... E05D 15/401 312/325
2,872,698 A * 2/1959 Gommels ..... E05D 15/00 16/291
5,253,493 A * 10/1993 Ohashi ..... D06F 39/14 220/812
5,437,168 A * 8/1995 Mason ..... D06F 39/14 68/142
5,489,924 A * 2/1996 Shima ..... G06F 1/1616 345/173

(Continued)

FOREIGN PATENT DOCUMENTS

CN 1150194 A 5/1997
CN 1150196 A 5/1997

(Continued)

OTHER PUBLICATIONS

Machine translation JP 08-084891, printed Feb. 25, 2016.*

*Primary Examiner* — Leslie A Nicholson, III
*Assistant Examiner* — Kimberley S Wright
(74) *Attorney, Agent, or Firm* — Dentons US LLP

(57) ABSTRACT

A laundry treatment apparatus including a casing having an upwardly open laundry entrance a door for opening/closing the laundry entrance, and an operation unit for receiving predetermined control instructions to control an operation of the laundry treatment apparatus, in which the operation unit is disposed on a front portion of the door and moves on the top of the casing when the door opens.

5 Claims, 7 Drawing Sheets

(56) References Cited

U.S. PATENT DOCUMENTS 5,724,837 A * 3/1998 Shin ..... D06F 39/14 160/188
5,857,363 A * 1/1999 Jung ..... D06F 39/14 160/206
6,233,981 B1 * 5/2001 Grandpierre ..... D06F 37/10 68/140
6,343,492 B1 * 2/2002 Seagar ..... D06F 39/12 68/139
6,903,927 B2 * 6/2005 Anlauff ..... G06F 1/162 341/22
7,032,350 B2 * 4/2006 Bienick ..... D06F 37/18 49/501
7,184,263 B1 * 2/2007 Maskatia ..... G06F 1/1616 248/917
7,313,932 B2 * 1/2008 Ryohke ..... D06F 19/00 68/13 R
7,490,495 B2 * 2/2009 Kim ..... D06F 39/14 134/200
7,614,263 B2 * 11/2009 Kim ..... F24C 15/02 68/12.26
8,047,026 B2 * 11/2011 Won ..... D06F 39/14 68/196
8,792,236 B2 * 7/2014 Tomita ..... G06F 1/1616 361/679.56
8,908,364 B2 * 12/2014 Tseng ..... G06F 1/1616 248/921
9,110,631 B2 * 8/2015 Oakley ..... G06F 1/1616
9,218,022 B2 * 12/2015 Tseng ..... G06F 1/1616
2003/0061841 A1 * 4/2003 Nakamura ..... D06F 37/10 68/12.26
2004/0144138 A1 * 7/2004 Takeuchi ..... D06F 39/14 68/24
2004/0231062 A1 * 11/2004 Sharrow ..... D06F 37/10 8/158
2006/0077622 A1 * 4/2006 Keely ..... G06F 1/1616 361/679.09
2006/0086151 A1 * 4/2006 Kim ..... D06F 39/14 68/196
2006/0086152 A1 * 4/2006 Kim ..... D06F 39/14 68/196
2006/0086153 A1 * 4/2006 Kim ..... D06F 39/14 68/196
2006/0086154 A1 * 4/2006 Kim ..... D06F 39/14 68/196
2006/0086155 A1 * 4/2006 Kim ..... D06F 39/14 68/196
2006/0090521 A1 * 5/2006 Kim ..... D06F 39/14 68/3 R
2007/0030634 A1 * 2/2007 Maskatia ..... G06F 1/1616 361/679.27
2013/0091903 A1 * 4/2013 Thorpe ..... D06F 39/12 68/210
2013/0128442 A1 * 5/2013 Tseng ..... G06F 1/1616 361/679.09

FOREIGN PATENT DOCUMENTS

CN 1676736 A 10/2005
CN 1690296 A2 11/2005
CN 1766206 A 5/2006
CN 2830463 Y 10/2006
JP 08084891 A 4/1996
JP 2000342893 A 12/2000
JP 2002085891 A 3/2002
JP 2004167108 A 6/2004
KR 2019980035649 U 9/1998
KR 1020020069736 A 9/2002
KR 1020030075922 A2 9/2003
KR 1020060036538 A 5/2006
KR 1020070092861 A 9/2007

* cited by examiner

LAUNDRY TREATMENT APPARATUS

CROSS-REFERENCE TO RELATED APPLICATION

This application claims the priority benefit of Korean Patent Application No. 10-2013-0112152, filed on Sep. 17, 2013, in the Korean Intellectual Property Office, the disclosure of which is incorporated herein by reference.

BACKGROUND

1. Field

The present disclosure relates to a laundry treatment apparatus allowing laundry to be easily taken out.

2. Description of the Related Art

In general, a laundry treatment apparatus is an apparatus for treating laundry through the application of physical and/or chemical action to the laundry. A washing machine that removes dirt from laundry, a spin dryer that spin-dries laundry by rotating a tub with the laundry therein, and a drying machine that dries wet laundry through the application of cool air or hot air into a tub are, in combination, called a laundry treatment apparatus.

FIG. 7 is a view showing an exemplary washing machine of the related art.

The exemplary washing machine includes a cabinet 1, a top cover 2, a door 3, a control panel 4, and an inner tub 5.

The cabinet 1 is open upward, the inner tub 5 is rotatably disposed in the cabinet 1, and laundry is loaded into the inner tub 5. Though not shown, an outer tub for receiving washing water is disposed in the cabinet 1 and the inner tub 5 is rotated inside the outer tub. Further, as is well known in the art, the washing machine is further equipped with a water supply unit for supplying water into the outer tub or the inner tub 5, a driving unit for rotating the inner tub 5, and a draining unit for draining the outer tub.

The top cover 2 is disposed on the open top of the cabinet 1 and has a laundry entrance for loading and unloading laundry. The door 3 is connected via hinges to the top cover 2, facilitating the opening/closing of the laundry entrance.

An input unit for inputting various control instructions to control the operation of the washing machine and a control panel 4 providing a display for indicating the operational state of the washing machine are disposed on the front of the top cover 2. The control panel 4 is independent from the door 3, that is, control panel 4 remains fixed regardless of the open/close status of the door 3.

In the exemplary configuration, a user has to bend over, potentially stretch, and put his/her hands into the inner tub 5 to take out the laundry in the inner tub 5. However, considering the recent tendency of increases in the capacity of washing machines, users may have difficulty reaching the inner tub 5 with their hands, depending on their physical conditions.

In particular, in top-loading washing machines into which laundry is loaded through a laundry entrance at the top of the washing machine it is preferable to lower the front in order for the user to easily unload the laundry, because the high front interferes with a user bending over. However, when the overall height of the washing machine is decreased for only the convenience of unloading laundry, the space inside the cabinet 1 is decreased accordingly, resulting in decrease of capacity of the internal tub 5.

Therefore, what is needed is to improve convenience of loading and unloading laundry without changing the capacity and function of a washing machine.

SUMMARY

Embodiments of the present invention have been made in an effort to provide a laundry treatment apparatus allowing for easy unloading of laundry.

One embodiment of the present invention provides a laundry treatment apparatus comprising a casing having an upwardly open laundry entrance, a door for opening/closing the laundry entrance, and an operation unit for receiving predetermined control instructions to control an operation of the laundry treatment apparatus, in which the operation unit is disposed on a front portion of the door and moves on the top of the casing when the door opens.

Another embodiment of the present invention provides a laundry treatment apparatus comprising a casing having a laundry entrance, a door for opening/closing the laundry entrance, and an operation unit for receiving predetermined control instructions to control an operation of the laundry treatment apparatus, in which the door includes a plurality of links connected by joints having predetermined degrees of freedom with respect to each other, the links include a link having a free end that moves on the top of the casing when the laundry entrance opens/closes and a link connected to rotate with respect to the casing and rotating with the operation of the link moving on the top of the casing, and the operation unit is disposed on the link moving on the top of the casing.

Another embodiment of the present invention provides a laundry treatment apparatus comprising a casing having a laundry entrance, a door for opening/closing the laundry entrance, and an operation unit disposed on the door for receiving predetermined control instructions to control an operation of the laundry treatment apparatus, in which the operation unit is positioned on a front portion of the top of the casing, when the laundry entrance is closed by the door, and is moved with the door such that the front portion of the top of the casing is exposed, when the laundry entrance is open.

Another embodiment of the present invention provides a laundry treatment apparatus comprising a casing having a laundry entrance, a door for opening/closing the laundry entrance, an inner tub disposed in the casing for receiving laundry, and an operation unit disposed on the door for receiving predetermined control instructions to control an operation of the laundry treatment apparatus, in which the operation unit is disposed on the front portion of the top of the casing, the overall height of the laundry treatment apparatus with the laundry entrance closed by the door is defined as the distance to the top of the operation unit, and when the laundry entrance is open, the operation unit moves with the door such that a height of the front of the top of the casing for unloading the inner tub is smaller than the overall height.

According to the laundry treatment apparatus of the present invention, since the operation unit moves with the door, when the door opens, the height of the front of the washing machine which a user has to overcome to unload out laundry decreases.

Further, according to the laundry treatment apparatus of the present invention, since it is possible to operate the operation unit even with the door open, usability is improved.

BRIEF DESCRIPTION OF THE DRAWINGS

The above and other objects, features, and other advantages of embodiments of the present invention will be more clearly understood from the following detailed description taken in conjunction with the accompanying drawings, in which.

DETAILED DESCRIPTION OF THE PREFERRED EMBODIMENTS

Advantages and features of the present invention and a method of achieving the same will be more clearly understood from non-limiting embodiments described below with reference to the accompanying drawings. Wherever possible, the same reference numbers will be used throughout the specification to refer to the same or like parts.

Figure 1:
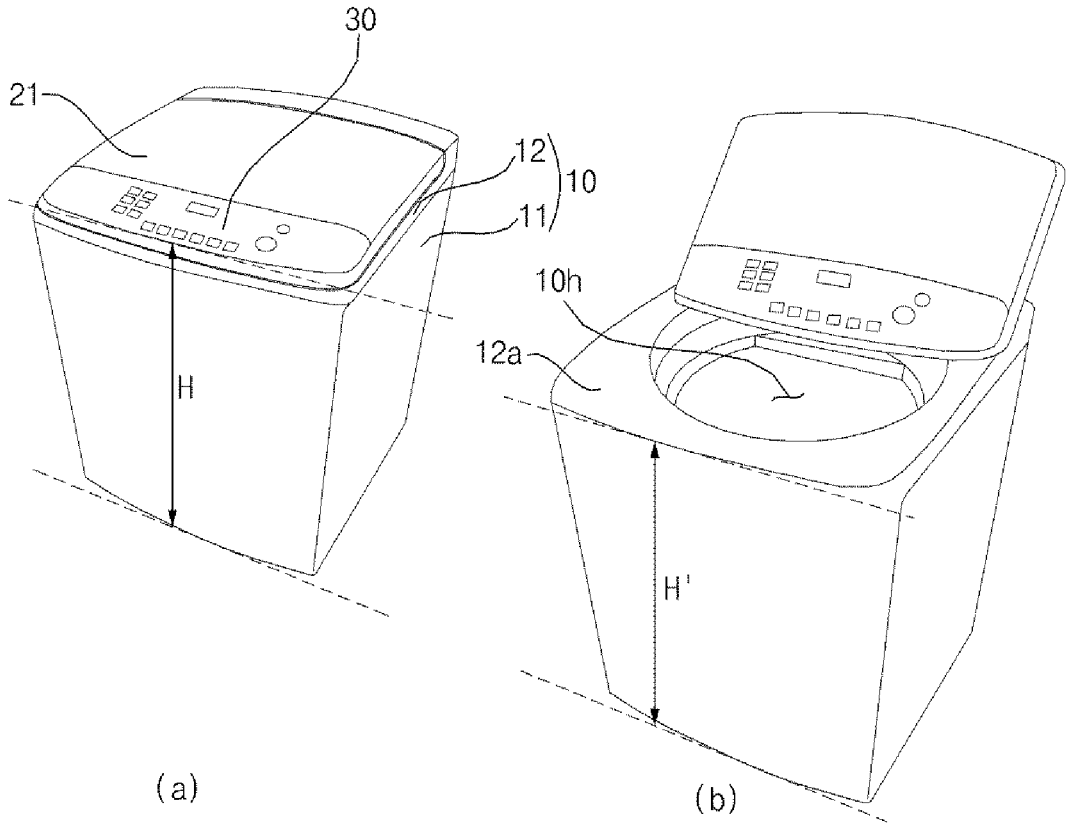
FIG. 1 is a view comparing a state (a) with a door closed and a state (b) with the door open, of a laundry treatment apparatus according to an embodiment of the present invention.
Figure 2:
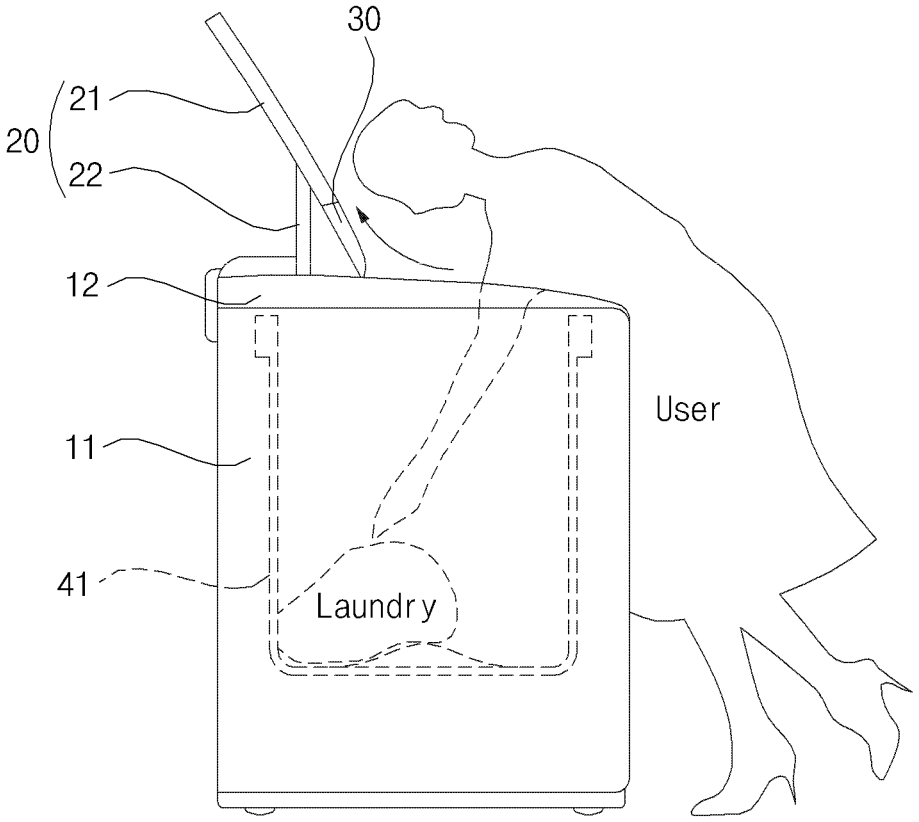
FIG. 2 is a schematic cross-sectional view showing the laundry treatment apparatus of FIG. 1.
Figure 3:
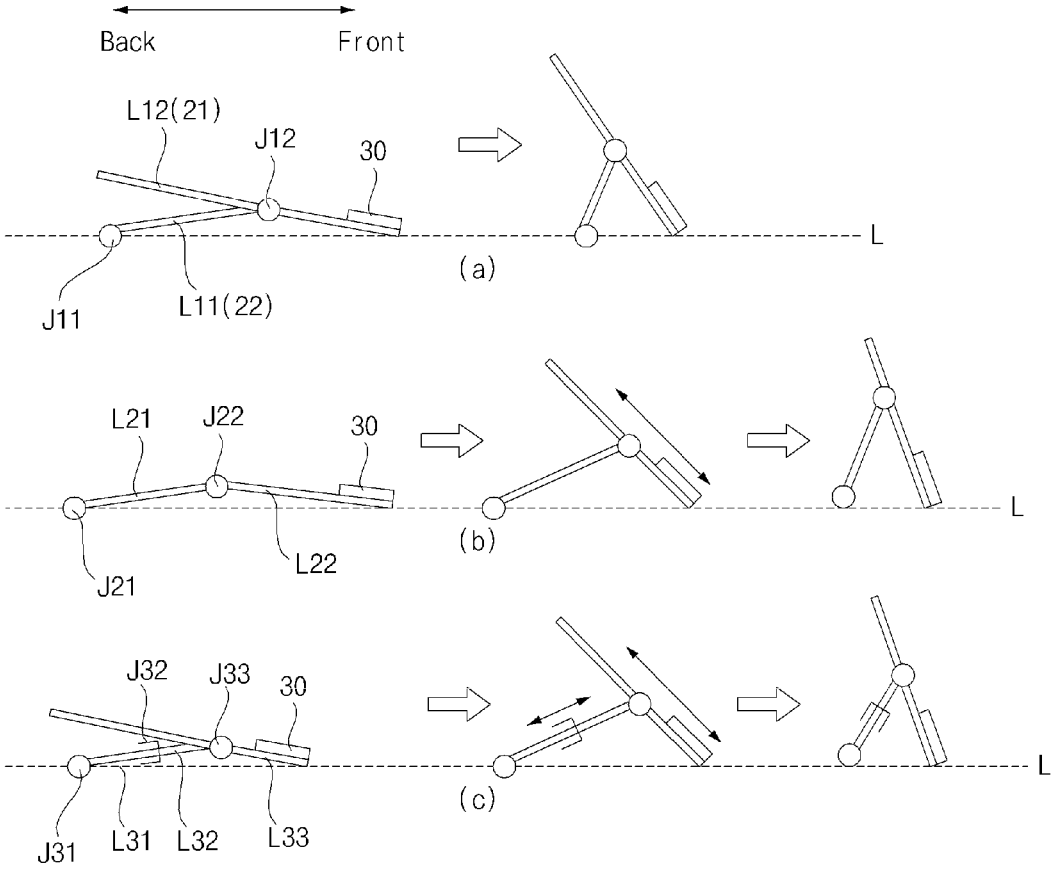
FIG. 3 is a view schematically showing embodiments of doors that can be used for the laundry treatment apparatus of the present invention.

FIG. 1 is a view comparing a state (a) with a door closed and a state (b) with the door open, of a laundry treatment apparatus according to an embodiment of the present invention. FIG. 2 is a schematic cross-sectional view showing the laundry treatment apparatus of FIG. 1. FIG. 3 is a view schematically showing embodiments of doors that can be used for the laundry treatment apparatus of the present invention.

Hereinafter, a washing machine of a laundry treatment apparatus will be described, but the present invention is not limited thereto.

A washing machine according to an embodiment of the present invention includes a casing 10 that forms the external appearance and has a laundry entrance 10*h* and a door 20 that opens/closes the laundry entrance 10*h*.

The laundry entrance 10*h* is open upward such that laundry can be loaded from above. Depending on the embodiment, the casing 10 may include a cabinet 11 and a top cover 12.

The cabinet 11 is open at the top and an inner tub 41 receiving laundry is rotatably disposed in the cabinet 11.

Though not shown, an outer tub for receiving washing water is disposed in the cabinet 11 and the inner tub 41 is rotated inside the outer tub. Further, as is well known in the art, the washing machine is further equipped with a water supply unit for supplying water into the outer tub or the inner tub 41, a driving unit for rotating the inner tub 41, and a draining unit for draining the outer tub.

The top cover 12 is disposed on the open top of the cabinet 11 and has the laundry entrance 10*h* for loading and unloading laundry. The door 20 is connected to the top cover 12 and opens/closes the laundry entrance 10*h*.

The door 20 laterally closes the laundry entrance 10*h* on the top 12*a* of the top cover 12 and is opened by applying force to its front. As the door 20 opens, the front of the door 20 moves backward, where the front of the door 20 can be supported by the top 12*a* of the top cover 12. FIG. 3 shows various embodiments of the door 20, and particularly, the configuration shown in (a) of FIG. 3 is a schematic example of the embodiment shown in FIGS. 1 and 2.

Referring to FIG. 3, the door 20 may include a plurality of links connected by joints having predetermined degrees of freedom there between for opening/closing the door 20. The links have free ends and include links L12, L22, L33 of which the free ends move on the top of the casing 10 or the top cover 12, when the laundry entrance 10*h* opens/closes, and links L11, L21, L31 turning with the links L12, L22, L33 moving on the top 12*a* of the top cover 12, with respect to the top cover 12.

An operation unit 30 is disposed on the links L12, L22, L33 moving on the top of the top cover 12. The operation unit 30 receives predetermined control instructions to control the operation of the laundry treatment apparatus and includes one or more input units. The operation unit 30 may further include a display unit to indicate the operational state of the laundry treatment apparatus.

Referring to FIG. 2 and FIG. 3(*a*), door 20 may include a lid 21 opening/closing the laundry entrance 10*h* and a connection link 22 connecting lid 21 so that lid 21 can turn with respect to top cover 12. The connection link 22, which is a link turning with respect to top cover 12, has one end rotatably connected to top cover 12 and other end rotatably connected between the front and the rear of lid 21. Door 20 has a fixed joint J11 at the connection portion between the connection link 22 and the top cover 12 and a movable joint J12 at the connection portion between the connection link 22 and the lid 21.

Operation unit 30 is disposed on the front portion of lid 21. When a backward force is applied to the front of the lid 21, the front of lid 21 moves backward on the top cover 12, the laundry entrance 10*h* opens, and the movable joint J12 moves up. With lid 21 fully open, the input unit or the display unit of operation unit 30 faces substantially the front from the washing machine, such that a user can easily operate the operation unit 30 even with the door 20 open.

Referring to FIG. 3(*b*), the door 20 may include a lid L22 opening/closing the laundry entrance 10*h* and a connection link L21 connecting lid 22 so that lid 22 can turn with respect to top cover 12. Door 20 has a fixed joint J21 at the connection portion of the connection link L21 and top cover 12, but unlike the embodiment described above with reference to FIG. 3(*a*), a movable joint J22 connecting connection link L21 and lid L22 moves perpendicular to the rotational axis and allows the connection link L21 not only to turn with respect to the lid L22, but to move on the lid L22.

The operation unit 30 is disposed on the front portion of lid L22. When a backward force is applied to the front of lid L22, the front of the lid L22 moves backward on the top cover 12, the laundry entrance 10*h* opens, and the movable joint J22 moves on the lid L22.

Referring to FIG. 3(*c*), door 20 may include a lid L33 opening/closing the laundry entrance 10*h* and two or more connection links L31 and L32 connecting lid L33 so that lid L33 can turn with respect to top cover 12. Door 20 has a fixed joint J31 at the connection portion of the first connection link L31 and top cover 12, and the first connection link L31 and the second connection link L32 are connected by a prismatic joint J32 longitudinally movable between the connection links.

Further, door 20 may have a movable joint J33 connecting the second connection link L32 and lid L33, and, the movable joint J33, as in FIG. 3(*b*), may allow not only turning, but moving.

Operation unit 30 is disposed on the front portion of lid L33. When a backward force is applied to the front of lid L33, the front of lid L33 moves backward on top cover 12 and the laundry entrance 10*h* opens, in which the prismatic joint J32 adjusts the distance between the first connection link L31 and the second connection link L32 in accordance with the movement distance of the movable joint J33.

In these embodiments, the operation unit 30 is disposed on the front portion of the door 20. When the door 20 opens/closes, the operation unit 30 moves with the door 20. Accordingly, when the door 20 is closed, the operation unit 30 is disposed at the front portion on top cover 12, covering the front portion of casing 10 or the top 12*a* of the top cover 12, and when the door 20 opens, it moves with door 20 and the front portion of the top 12*a* of the top cover 12 is exposed.

The height H of the front end of the washing machine with door 20 closed can be defined as the distance from the floor where the washing machine is placed to the top of the operation unit 30 (see FIG. 1(*a*)). The height H of the front end of the washing machine includes the height that the operation unit 30 occupies. The height H' of the front end of the washing machine with door 20 open may be a height that a user has to overcome to unload laundry from inner tub 41. The operation unit 30 moves backward with door 20, when the door 20 opens, such that the height H' of the front end of the washing machine with door 20 open is smaller than the height H and accordingly the user can more easily unload laundry.

Figure 4:
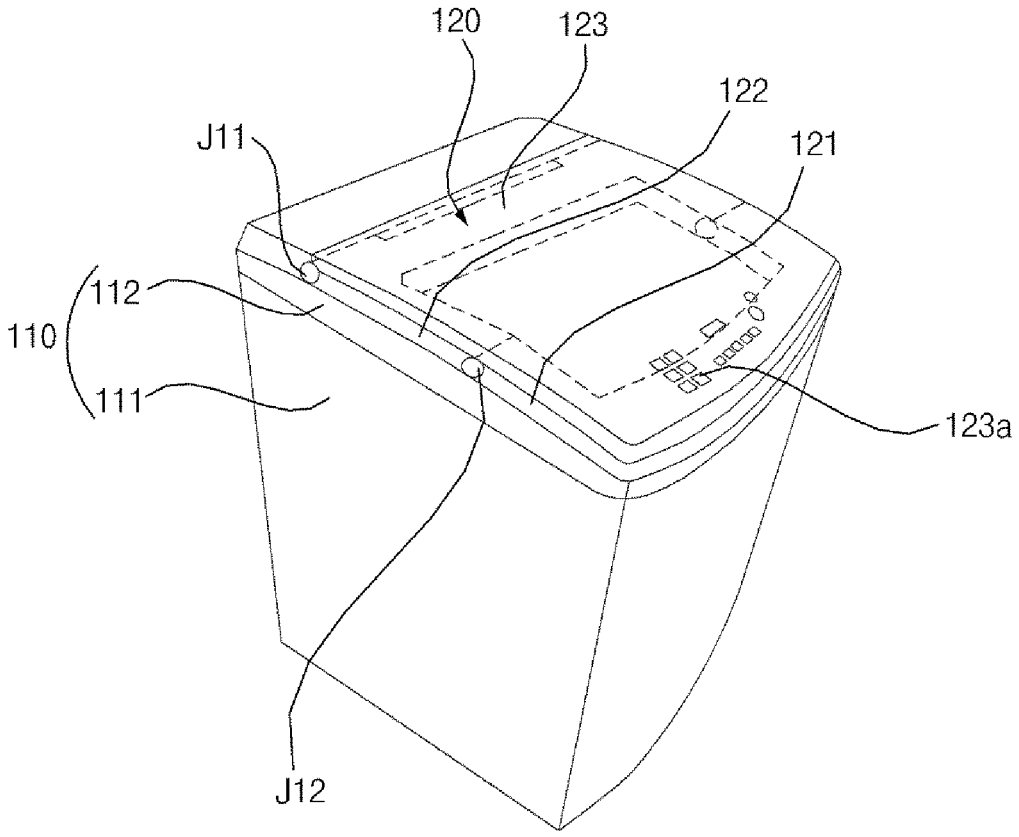
FIG. 4 is a perspective view of a laundry treatment apparatus according to another exemplary embodiment of the present invention.
Figure 5:
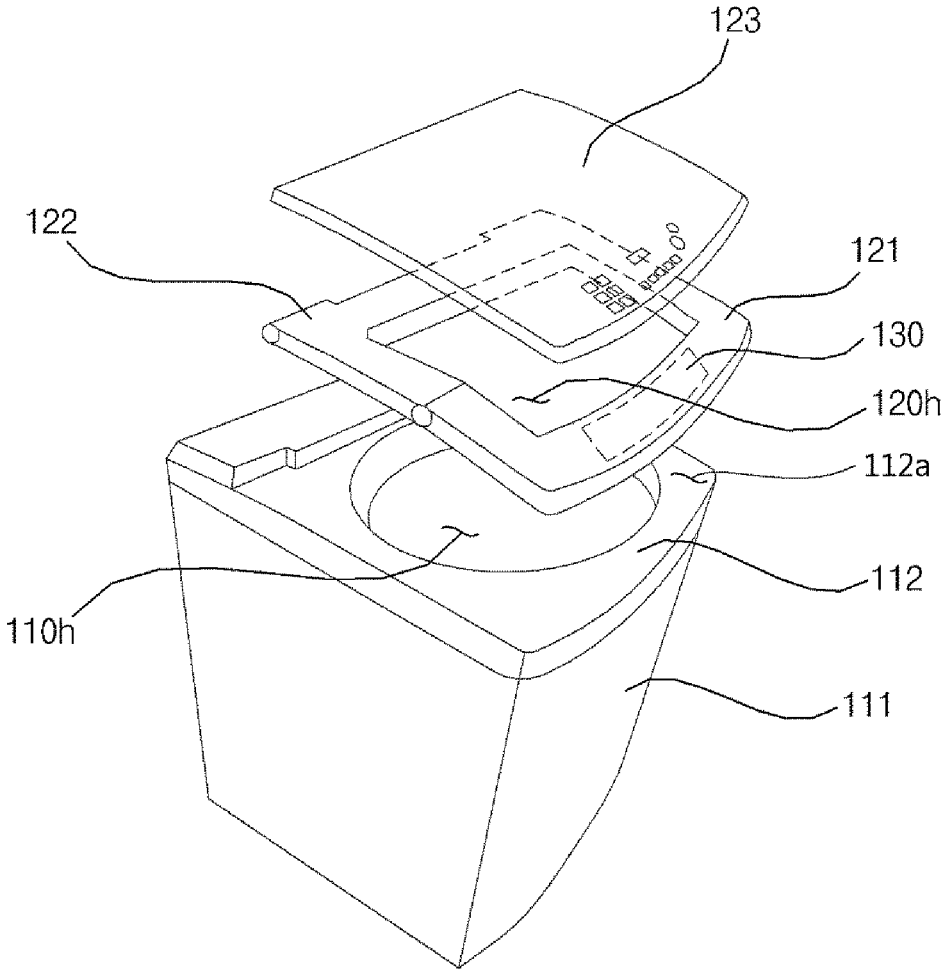
FIG. 5 is an exploded perspective view of the laundry treatment apparatus of FIG. 4.
Figure 6:
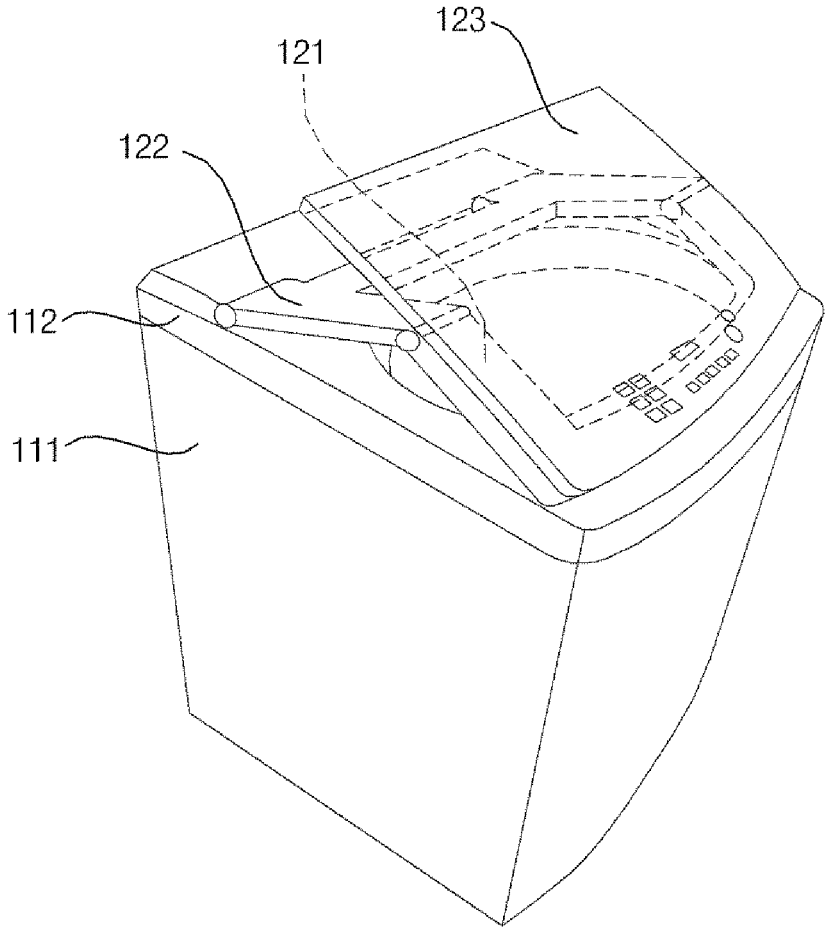
FIG. 6 is a view showing the laundry treatment apparatus of FIG. 4 with the door open.
Figure 7:
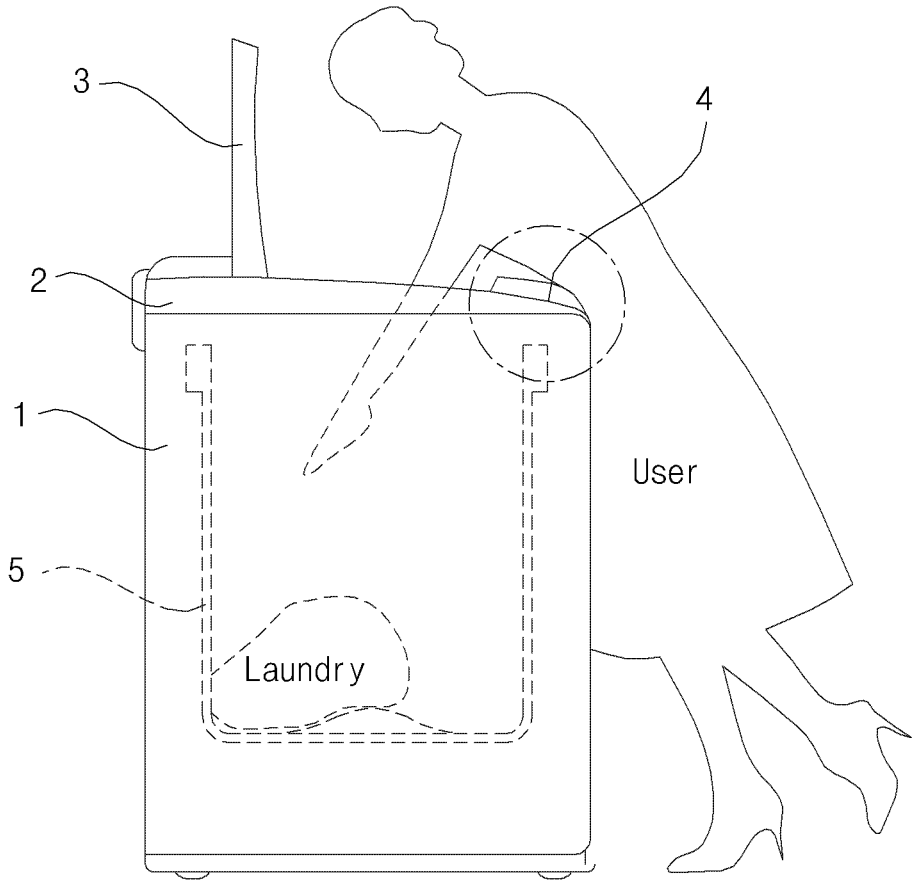
FIG. 7 is a view showing a washing machine of the related art.

FIG. 4 is a perspective view of a laundry treatment apparatus according to another exemplary embodiment of the present invention. FIG. 5 is an exploded perspective view of the laundry treatment apparatus of FIG. 4. FIG. 6 is a view showing the laundry treatment apparatus of FIG. 4 with the door open.

Referring to FIGS. 4 to 6, a washing machine according to another embodiment of the present invention includes a first door frame 121 of which the front moves on the top of a casing 110 (hereafter, the top 112*a* of a top cover 112 is exemplified) and a second door frame 122 turning with respect to the top cover 112 with movement of the first door frame 121. Preferably, one end of the second door frame 122 may be rotatably connected to the top cover 112 and the other end may be rotatably connected to the first door frame 121. The operation unit 130 is disposed on the first door frame 121.

A rotational axis of the first door frame 121 to the second door frame 122 is not positioned on the line (L, see FIG. 3(*a*)) connecting the front of the first door frame 121 with the rotational axis of the second door frame 122 to the top cover 112. Door 120 may have a joint J12 connecting the first door frame 121 and the second door frame 122. Preferably, the rotational axis of joint J12 may be positioned above the line L.

Joint J12 connects the second door frame 122 so that the second door frame 122 can turn with respect to the top cover 112.

With door 120 closed, the first door frame 121 and the second door frame 122 are not aligned on a straight line, but maintain a predetermined alignment angle, and the angle decreases, as the door 120 opens.

A window 120*h* through which a user can see the inside of casing 10 may be disposed on at least one of the first door frame 121 and the second door frame 122. In this case, door 120 may further include a transparent member 123 covering the window 120*h*.

Transparent member 123 may be a plate made of a transparent or translucent material which can transmit light, for example, reinforced glass or synthetic resin, and preferably made of a hard material having sufficient rigidity for durability, but it is not limited thereto and may be formed in the type of film that can deform a little.

To facilitate operation of the operation unit 130 by touching the transparent member 123, the operation unit 130 may include a touch type input unit using static electricity or static pressure, and accordingly, marks 123*a* for discriminating menus on the operation unit may be disposed on transparent member 123.

Transparent member 123 may be supported by the first door frame 121 and the second door frame 122 under it, when door 120 is closed, and it may be separated from the second door frame 122, and be supported solely by the first frame 121, when door 120 is open. Preferably, transparent member 123 is coupled to first door frame 121.

Although the preferred embodiments of the present invention have been disclosed for illustrative purposes, those skilled in the art will appreciate that various modifications, additions and substitutions are possible, without departing from the scope and spirit of the invention.

What is claimed is:

1. A laundry treatment apparatus comprising:

a casing having an upwardly open laundry entrance on a top thereof;

a door that opens the laundry entrance at an opened position and closes the laundry entrance at a closed position, the door comprising:

a first door frame of which a front side moves on the top of the casing; and a second door frame that has a rear side rotatably connected to the casing and a front side rotatably connected to the first door frame and rotates with respect to the casing when the first door frame moves; and an operation unit that provides an input unit for receiving predetermined control instructions to control an operation of the laundry treatment apparatus and a display unit to indicate an operational state of the laundry treatment apparatus, wherein the laundry entrance is opened and closed by at least one of the first door frame and the second door frame, and the operation unit is disposed on the first door frame, and wherein a rotational axis of the first door frame to the second door frame is located above a straight line connecting the rear side of the second door frame and the front side of the first door frame when the door is at fully closed position.

2. The laundry treatment apparatus of claim 1, wherein the front side of the second door frame is connected to a rear side of the first door frame.

3. The laundry treatment apparatus of claim 1 further comprising:

a window formed on at least one of the first door frame and the second door frame, and the door further includes a transparent member covering the window.

4. The laundry treatment apparatus of claim 3, wherein the transparent member is supported by the first door frame and the second door frame, when the door is closed, and is separated from the second door frame, and supported solely by the first door frame, when the door is open.

5. The laundry treatment apparatus of claim 1, wherein the operation unit is located at the front portion of the top of the casing when the door is closed, wherein the overall height of the laundry treatment apparatus with the laundry entrance closed by the door is defined as the distance to the top of the operation unit, and wherein, when the laundry entrance is open, the operation unit moves with the door such that a height of the front of the top of the casing for unloading the inner tub is smaller than the overall height.

* * * * *